US006438834B1

(12) United States Patent
Takamatsu et al.

(10) Patent No.: US 6,438,834 B1
(45) Date of Patent: Aug. 27, 2002

(54) METHOD OF MAKING A SWASH PLATE TYPE COMPRESSOR PISTON WHOSE HEAD PORTION IS FORMED BY PORE-FREE DIE-CASTING

(75) Inventors: Masato Takamatsu; Takayuki Kato; Seiji Katayama; Shigeo Fukushima, all of Kariya (JP)

(73) Assignees: Kabushiki Kaisha Toyoda Jidoshokki Seisakusho, Kariya; Altex Co., LTD, Hamakita, both of (JP)

( * ) Notice: Subject to any disclaimer, the term of this patent is extended or adjusted under 35 U.S.C. 154(b) by 0 days.

(21) Appl. No.: 09/666,148

(22) Filed: Sep. 20, 2000

(30) Foreign Application Priority Data

Sep. 21, 1999 (JP) ..... 11-267121
Sep. 21, 1999 (JP) ..... 11-267131
Oct. 13, 1999 (JP) ..... 11-291188

(51) Int. Cl.[7] ..... B23P 15/00

(52) U.S. Cl. ..... 29/888.022; 29/888.02; 29/888.047

(58) Field of Search ..... 29/888.047, 888.022, 29/888.06; 92/172, 176, 155, 248, 71; 123/193.6, 193.4, 193.2; 417/269; 91/499

(56) References Cited

U.S. PATENT DOCUMENTS 4,334,507 A * 6/1982 Kohnert et al. ..... 123/193 P
4,404,262 A * 9/1983 Watmough ..... 29/888.047
5,174,728 A 12/1992 Kimura et al. ..... 417/222
5,626,674 A * 5/1997 VanKuiken, Jr. et al. 29/888.06
5,797,311 A * 8/1998 Gasthuber et al. ..... 92/158

FOREIGN PATENT DOCUMENTS

JP 9-105380 4/1997
JP 10-159725 6/1998
JP 10-205440 8/1998

OTHER PUBLICATIONS

U.S. patent application Ser. No. 09/666,523, filed Sep. 20, 2000.
U.S. patent application Ser. No. 09/666,961, filed Sep. 20, 2000.

* cited by examiner

*Primary Examiner*—I Cuda-Rosenbaum
(74) *Attorney, Agent, or Firm*—Morgan & Finnegan, LLP

(57) ABSTRACT

A method of producing a piston for a swash plate type compressor including a head portion which is slidably fitted in a cylinder bore of the compressor, and an engaging section which engages a swash plate of the compressor, wherein a blank including a hollow cylindrical head section corresponding to the head portion and an engaging section corresponding to the engaging portion is formed by a pore-free die-casting method, such that the head section and the engaging section are formed integrally with each other at the closed end by the head section, and wherein a closing member is fixed to the hollow cylindrical head section so as to close its open end, for thereby providing the head portion of the piston.

12 Claims, 6 Drawing Sheets

METHOD OF MAKING A SWASH PLATE TYPE COMPRESSOR PISTON WHOSE HEAD PORTION IS FORMED BY PORE-FREE DIE-CASTING

This application is based on Japanese Patent Applications Nos. 11-267121 and 11-267131 both filed Sep. 21, 1999, and No. 11-291188 filed Oct. 13, 1999, the contents of which are incorporated hereinto by reference.

BACKGROUND OF THE INVENTION

1. Field of the Invention

The present invention relates in general to a method of producing a piston for a swash plate type compressor, and more particularly to a method of producing such a piston having a hollow cylindrical head portion.

2. Discussion of the Related Art

A piston used for a swash plate type compressor has a head portion which is slidably fitted in a cylinder bore formed in a cylinder block of the compressor, and an engaging portion which slidably engages the swash plate. Since the piston is reciprocated within the cylinder bore, it is desirable to reduce the weight of the piston. A single-headed piston is usually used in a swash plate type compressor of variable capacity type wherein the angle of inclination of a swash plate is variable to change the discharge capacity of the compressor. When the single-headed piston is used in the variable capacity type swash plate compressor, it is particularly required to reduce its weight in order to achieve a stable operation of the compressor and reduce the noise of the compressor during its operation. To this end, various methods have been proposed to form the piston with a hollow head portion.

As one example of the method for forming the piston with a hollow head portion, there are formed by forging a hollow cylindrical head member which is open at one of its opposite ends, and an engaging member with which a cover is integrally formed for closing the open end of the head member. The engaging member engages a swash plate of the compressor. The head member and the engaging member are connected together by welding, with the open end of the head member being closed by the cover. According to this method, the weight of the piston can be reduced by reducing the cylindrical wall thickness of the head member. In the piston constructed as described above, however, a connection, at which the head member and the engaging member are connected, is located at an axially intermediate portion of the piston, so that the piston tends to be subjected to a relatively large force at the connection during the reciprocating movement of the piston, undesirably deteriorating the durability of the piston. Further, this method pushes up the cost of manufacture of the piston.

As another method for forming the piston with a hollow head portion, a body member is formed by die-casting. The body member includes a hollow cylindrical head section which has an open end and a closed end, and an engaging section which is formed integrally with the head section. A closing member is fixed to the head section so as to close the open end. However, the head section of the body member which is formed by a conventional die-casting method does not have a sufficiently reduced cylindrical wall thickness, and needs to be subjected to a machining operation on its inner circumferential surface for reducing the cylindrical wall thickness.

SUMMARY OF THE INVENTION

The present invention was made in the light of the background art described above. It is an object of the present invention to provide a method of producing a swash plate type compressor piston whose head portion has a sufficiently reduced wall thickness and which can be produced at a relatively low cost.

The object indicated above may be achieved according to any one of the following forms or modes of the present invention, each of which is numbered like the appended claims and depend from the other form or forms, where appropriate, to indicate and clarify possible combinations of technical features of the present invention, for easier understanding of the invention. It is to be understood that the present invention is not limited to the technical features and their combinations described below. It is also to be understood that any technical feature described below in combination with other technical features may be a subject matter of the present invention, independently of those other technical features.

(1) A method of producing a piston for a swash plate type compressor including a head portion which is slidably fitted in a cylinder bore of the compressor, and an engaging section which engages a swash plate of the compressor, the method comprising the steps of forming a blank by a pore-free die-casting method, the blank including a hollow cylindrical head section which corresponds to the head portion and which has a closed end and an open end, and an engaging section which corresponds to the engaging portion and which is formed integrally with the hollow cylindrical head section at the closed end; and fixing a closing member to the hollow cylindrical head section so as to close the open end, for thereby providing the head portion of the piston.

The pore-free die-casting method prevents a gas from being trapped in a die-cast article, by introducing a molten metal such as a molten aluminum alloy into a mold cavity of a casting mold, while the mold cavity is filled with a reactive gas such as an oxygen, so that the mold cavity is placed in a highly vacuum state owing to a reaction between the molten metal and the reactive gas. The die-cast article formed by the pore-free die-casting method described above exhibits a high degree of mechanical strength with a relatively small wall thickness. The present arrangement wherein the closing member closes the open end of the hollow cylindrical head section on the side remote from the engaging section assures a higher degree of durability of the piston during use, than an arrangement wherein the closing member closes the open end of the head section on the side of the engaging section.

While the method according to the present invention is suitable for producing a single-headed piston used for a swash plate type compressor of variable capacity type, the present method is equally applicable for producing a piston used for a swash plate type compressor of fixed capacity type, and a double-headed piston.

(2) A method according to the above mode (1), further comprising a step of: preparing a casting mold consisting of two mold halves which define a parting plane that includes a centerline of the hollow cylindrical head section, at least in a portion of the mold halves which gives the head section, the casting mold being provided with a slide core which is movable in a direction parallel to the centerline of the head section and which gives an inner circumferential surface of the head section.

The arrangement according to the above mode (2) permits easy die-casting of the blank including the hollow cylindrical head section which gives the hollow head portion of the piston.

(3) A method according to the above mode (1) or (2), the hollow cylindrical head section has a cylindrical wall thickness of not larger than 1.8 mm.

The pore-free die-casting method described above is advantageous for producing a thin-walled die-cast article. By suitably determining the die-casting condition in producing the blank for the piston, the cylindrical wall thickness of the head section of the blank can be reduced to not greater than 1.8 mm, 1.5 mm, or 1.2 mm.

(4) A method according to any one of the above modes (1)~(3), the step of forming the blank comprises forming two body members each having the engaging section and the hollow cylindrical head section, the two body members being integrally connected to each other at their ends on the side of the engaging sections, such that the hollow cylindrical head sections of the two body members are concentric with each other, and such that each of the head sections of the two body members is open at one of its opposite ends which is remote from the engaging sections.

The arrangement according to the above mode (4) is effective to reduce the cost of die-casting the body member for each piston while facilitating the machining operation to be effected thereon, resulting in a reduced cost of manufacture of the piston.

(5) A method according to any one of the above modes (1)–(4), at least a portion of the inner circumferential surface of the hollow cylindrical head section is not subjected to a machining operation.

The pore-free die-casting method permits production of a thin-walled die-cast article having high degrees of mechanical strength and dimensional accuracy. Accordingly, the body member formed by the pore-free die-casting method need not be subjected to a machining operation at least on the inner circumferential surface of the cylindrical head section except its axial open end portion to which the closing member is fixed.

(6) A method according to any one of the above modes (1)~(5), wherein the step of forming a blank comprises forming by pore-free die-casing an integral precursor including a first portion which gives the blank, and a second portion which gives the closing member, by using a casting mold having a mold cavity which includes a first cavity portion for forming the first portion of the integral precursor and a second cavity portion for forming the second portion of said integral precursor, the first and second cavity portions being held in communication with each other.

In the present arrangement wherein the second portion of the integral precursor, which gives the closing member, is die-cast concurrently and together with the first portion of the integral precursor, which gives the blank. The blank and the closing member are obtained by cutting the integral precursor which can be produced in one step with high efficiency. Accordingly, the cost of manufacture of the piston by die-casting can be significantly reduced.

(7) A method according to the above mode (6), wherein the second cavity portion is held in communication with a part of the first cavity portion, which part corresponds to the engaging section of the blank.

The engaging section which gives the engaging portion of the piston has the largest wall thickness in the piston, so as to meet the structural and functional requirements of the piston. The second cavity portion for providing the closing member is held in communication with a portion of the first cavity portion which has a comparatively large dimension corresponding to the thick-walled engaging section of the piston. Accordingly, the molten metal can easily flow from the first cavity portion corresponding to the engaging portion, into the second cavity portion corresponding to the closing member, whereby the second portion of the integral precursor can be formed with high stability, so as to die-cast the closing member with high stability.

BRIEF DESCRIPTION OF THE DRAWINGS

The above and optional objects, features, advantages and technical and industrial significance of the present invention will be better understood and appreciated by reading the following detailed description of a presently preferred embodiment of the invention, when considered in connection with the accompanying drawings, in which.

DETAILED DESCRIPTION OF THE PREFERRED EMBODIMENTS

Referring to the accompanying drawings, there will be described a presently preferred embodiment of the present invention as applied to the body member used for manufacturing a single-headed piston for a swash plate type compressor used for an air conditioning system of an automotive vehicle.

Figure 1:
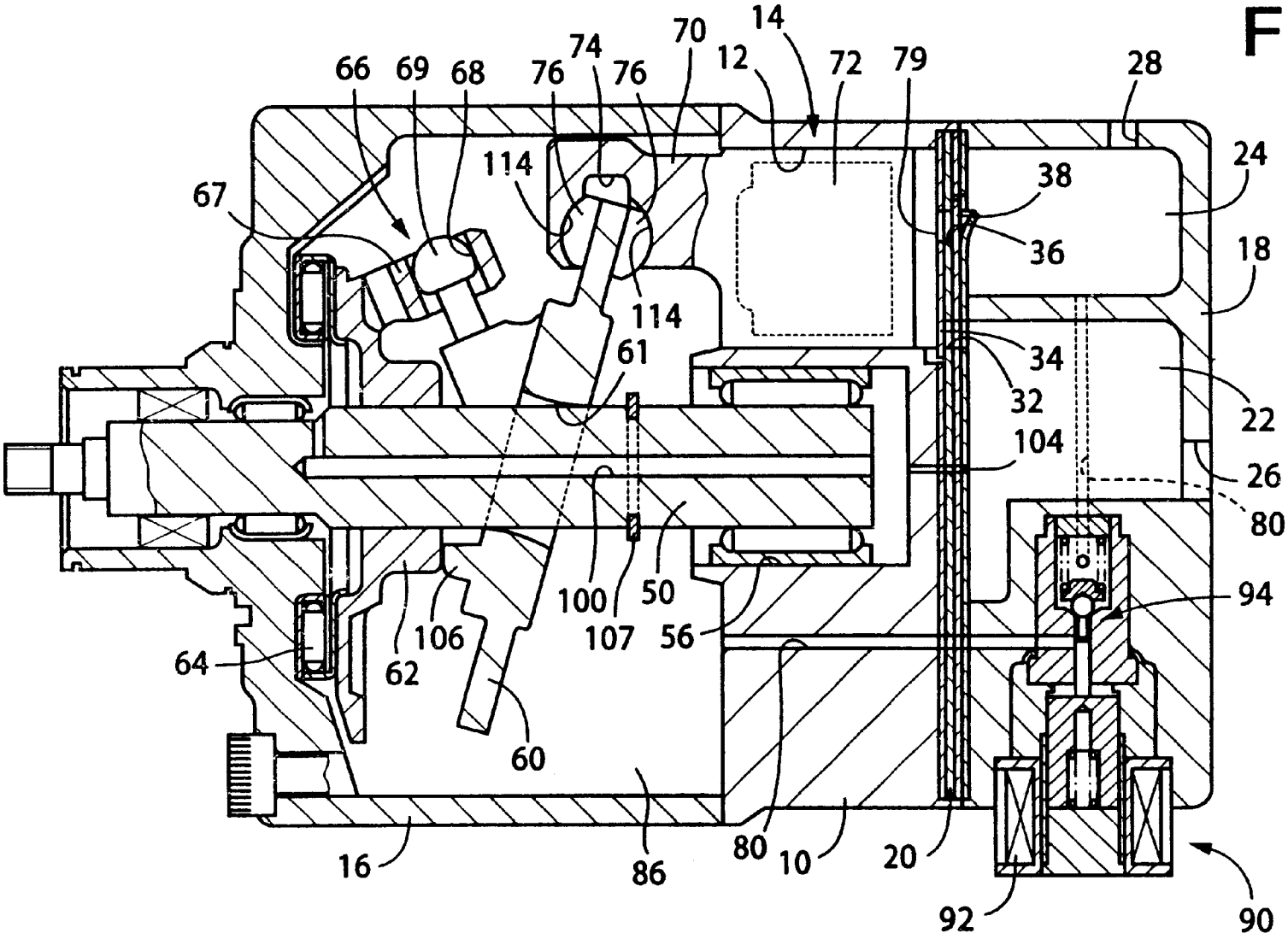
FIG. 1 is front elevational view in cross section of a swash plate type compressor equipped with a piston constructed according to one embodiment of the present invention.

Referring first to FIG. 1, there is shown a compressor of swash plate type incorporating a plurality of single-headed pistons (hereinafter referred to simply as "pistons") each constructed according to one embodiment of the present invention.

In FIG. 1, reference numeral 10 denotes a cylinder block having a plurality of cylinder bores 12 formed so as to extend in its axial direction such that the cylinder bores 12 are arranged along a circle whose center lies on a centerline of the cylinder block 10. The piston generally indicated at 14 is reciprocably received in each of the cylinder bores 12. To one of the axially opposite end faces of the cylinder block 10, (the left end face as seen in FIG. 1, which will be referred to as "front end face"), there is attached a front housing 16. To the other end face (the right end face as seen in FIG. 1, which will be referred to as "rear end face"), there is attached a rear housing 18 through a valve plate 20. The front housing 16, rear housing 18 and cylinder block 10 cooperate to constitute a housing assembly of the swash plate type compressor. The rear housing 18 and the valve plate 20 cooperate to define a suction chamber 22 and a discharge chamber 24, which are connected to a refrigerating circuit (not shown) through an inlet 26 and an outlet 28, respectively. The valve plate 20 has suction ports 32, suction valves 34, discharge ports 36 and discharge valves 38.

A rotary drive shaft 50 is disposed in the cylinder block 10 and the front housing 16 such that the axis of rotation of the drive shaft 50 is aligned with the centerline of the cylinder block 10. The drive shaft 50 is supported at its opposite end portions by the front housing 16 and the cylinder block 10, respectively, via respective bearings. The cylinder block 10 has a central bearing hole 56 formed in a central portion thereof, and the bearing is disposed in this central bearing hole 56, for supporting the drive shaft 50 at its rear end portion. The front end portion of the drive shaft 50 is connected, through a clutch mechanism such as an electromagnetic clutch, to an external drive source (not shown) in the form of an engine of an automotive vehicle. In operation of the compressor, the drive shaft 50 is connected through the clutch mechanism to the vehicle engine in operation so that the drive shaft 50 is rotated about its axis.

The rotary drive shaft 50 carries a swash plate 60 such that the swash plate 60 is axially movable and tiltable relative to the drive shaft 50. The swash plate 60 has a central hole 61 through which the drive shaft 50 extends. The diameter of the central hole 61 of the swash plate 60 gradually increases in the axially opposite directions from its axially intermediate portion towards the axially opposite ends. To the drive shaft 50, there is fixed a rotary member 62 as a torque transmitting member, which is held in engagement with the front housing 16 through a thrust bearing 64. The swash plate 60 is rotated with the drive shaft 50 by a hinge mechanism 66 during rotation of the drive shaft 50. The hinge mechanism 66 guides the swash plate 60 for its axial and tilting motions. The hinge mechanism 66 includes a pair of support arms 67 fixed to the rotary member 62, guide pins 69 which are formed on the swash plate 60 and which slidably engage guide holes 68 formed in the support arms 67, the central hole 61 of the swash plate 60, and the outer circumferential surface of the drive shaft 50. It is noted that the swash plate 60 constitutes a drive member for driving the pistons 14, while the rotary drive shaft 50, the drive source in the form of the vehicle engine and the torque transmitting device in the form of the hinge mechanism 66 cooperate with each other to constitute a major portion of a drive device for driving the drive member.

The piston 14 indicated above includes an engaging portion 70 engaging the swash plate 60, and a head portion 72 formed integrally with the engaging portion 70 and fitted in the corresponding cylinder bore 12. The engaging portion 70 has a groove 74 formed therein, and the swash plate 60 is held in engagement with the groove 74 through a pair of hemi-spherical shoes 76. The hemispherical shoes 76 are held in the groove 74 such that the shoes 76 slidably engage the engaging portion 70 at their hemispherical surfaces and such that the shoes 76 slidably engage the radially outer portions of the opposite surfaces of the swash plate 60 at their flat surfaces. The configuration of the piston 14 will be described in detail.

A rotary motion of the swash plate 60 is converted into a reciprocating linear motion of the piston 14 through the shoes 76. A refrigerant gas in the suction chamber 22 is sucked into the pressurizing chamber 79 through the suction port 32 and the suction valve 34, when the piston 14 is moved from its upper dead point to its lower dead point, that is, when the piston 14 is in the suction stroke. The refrigerant gas in the pressurizing chamber 79 is pressurized by the piston 14 when the piston 14 is moved from its lower dead point to its upper dead point, that is, when the piston 14 is in the compression stroke. The pressurized refrigerant gas is discharged into the discharge chamber 24 through the discharge port 36 and the discharge valve 38. A reaction force acts on the piston 14 in the axial direction as a result of compression of the refrigerant gas in the pressurizing chamber 79. This compression reaction force is received by the front housing 16 through the piston 14, swash plate 60, rotary member 62 and thrust bearing 64.

Figure 2:
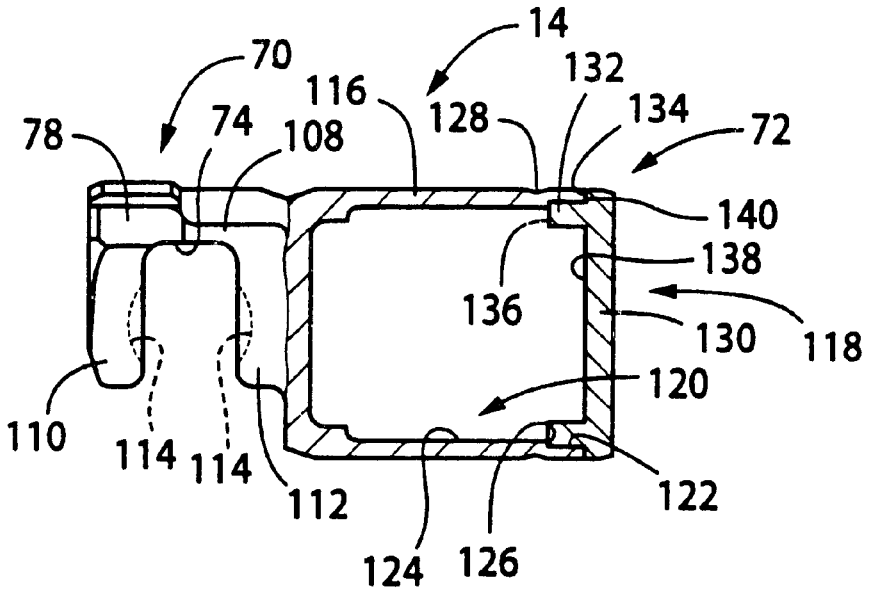
FIG. 2 is a front elevational view partly in cross section of the piston shown in FIG. 1.

As shown in FIG. 2, the engaging portion 70 of the piston 14 has an integrally formed rotation preventive part 78, which is arranged to contact the inner circumferential surface of the front housing 16, for thereby preventing a rotary motion of the piston 14 about its centerline.

The cylinder block 10 has a supply passage 80 formed therethrough for communication between the discharge chamber 24 and a crank chamber 86 which is defined between the front housing 16 and the cylinder block 10. The supply passage 80 is connected to a solenoid-operated control valve 90 provided to control the pressure in the crank chamber 86. The solenoid-operated control valve 90 includes a solenoid coil 92, and a shut-off valve 94 which is selectively closed and opened by energization and de-energization of the solenoid coil 92. Namely, The shut-off valve 94 is placed in its closed state when the solenoid coil 92 is energized, and is placed in its open state when the coil 92 is de-energized.

The rotary drive shaft 50 has a bleeding passage 100 formed therethrough. The bleeding passage 100 is open at one of its opposite ends to the central bearing hole 56, and is open to the crank chamber 86 at the other end. The central bearing hole 56 communicates at its bottom with the suction chamber 22 through a communication port 104.

The present swash plate type compressor is a variable capacity type. By controlling the pressure in the crank chamber 86 by utilizing a difference between the pressure in the discharge chamber 24 as a high-pressure source and the pressure in the suction chamber 22 as a low pressure source, a difference between the pressure in the crank chamber 86 which acts on the front side of the piston 14 and the pressure in the pressurizing chamber 79 is regulated to change the angle of inclination of the swash plate 60 with respect to a plane perpendicular to the axis of rotation of the drive shaft 50, for thereby changing the reciprocating stroke (suction and compression strokes) of the piston 14, whereby the discharge capacity of the compressor can be adjusted.

As described above, the pressure in the crank chamber 86 is controlled by controlling the solenoid-operated control valve 90 to selectively connect and disconnect the crank chamber 86 to and from the discharge chamber 24. Described more specifically, when the solenoid coil 92 of the solenoid-operated control valve 90 is energized, the supply passage 80 is closed, so that the pressurized refrigerant gas in the discharge chamber 24 is not delivered into the crank chamber 86. In this condition, the refrigerant gas in the crank chamber 86 flows into the suction chamber 22 through the bleeding passage 100 and the communication port 104, so that the pressure in the crank chamber 86 is lowered, to thereby increase the angle of inclination of the swash plate 60. The reciprocating stroke of the piston 14 which is reciprocated by rotation of the swash plate 60 increases with an increase of the angle of inclination of the swash plate 60, so as to increase an amount of change of the volume of the pressurizing chamber 79, whereby the discharge capacity of the compressor is increased. When the solenoid coil 92 is de-energized, the supply passage 80 is opened, permitting the pressurized refrigerant gas to be delivered from the discharge chamber 24 into the crank chamber 86, resulting in an increase in the pressure in the crank chamber 86, and the angle of inclination of the swash plate 60 is reduced, so that the discharge capacity of the compressor is accordingly reduced.

The maximum angle of inclination of the swash plate 60 is limited by abutting contact of a stop 106 formed on the swash plate 60, with the rotary member 62, while the minimum angle of inclination of the swash plate 60 is limited by abutting contact of the swash plate 60 with a stop 107 in the form of a ring fixedly fitted on the drive shaft 50. The solenoid coil 92 of the solenoid-operated control valve 90 is controlled by a control device not shown depending upon a load acting on the air conditioning system including the present compressor. The control device is principally constituted by a computer. In the present embodiment, the supply passage 80, the crank chamber 86, the solenoid-operated control valve 90, the bleeding passage 100, the communication port 104, and the control device for the control valve 90 cooperate to constitute a major portion of a crank chamber pressure control device for controlling the pressure in the crank chamber 86, or a swash plate angle adjusting device for controlling the angle of inclination of the swash plate 60 (a discharge capacity adjusting device for adjusting the discharge capacity of the compressor).

The cylinder block 10 and each piston 14 are formed of an aluminum alloy. The piston 14 is coated at its outer circumferential surface with a fluoro resin film which prevents a direct contact of the aluminum alloy of the piston 14 with the aluminum alloy of the cylinder block 10 so as to prevent seizure therebetween, and makes it possible to minimize the amount of clearance between the piston 14 and the cylinder bore 12. The cylinder block 10 and the piston 14 may also be formed of an aluminum silicon alloy. Other materials may be used for the cylinder block 10, the piston 14, and the coating film.

There will next be described the configuration of the piston 14.

The end portion of the engaging portion 70 of the piston 14, which is remote from the head portion 72, has a U-shape in cross section, as shown in FIG. 2. Described in detail, the engaging portion 70 has a base section 108 which defines the bottom of the U-shape and a pair of substantially parallel arm sections 110, 112 which extend from the base section 108 in a direction perpendicular to the axis of the piston 14. The two opposed lateral walls of the U-shape of the end portion of the engaging portion 70 have respective recesses 114 which are opposed to each other. Each of these recesses 114 is defined by a part-spherical inner surface of the lateral wall. The pair of shoes 76 indicated above are held in contact with the opposite surfaces of the swash plate 60 at its radially outer portion and are received in the respective part-spherical recesses 114. Thus, the engaging portion 70 slidably engages the swash plate 60 through the shoes 76.

The head portion 72 of the piston 14 is formed integrally with the engaging portion 70 on the side of its arm section 112, and includes a cylindrical body portion 116 which is open at one of its opposite ends on the side remote from the arm section 112 of the engaging portion 70, and a closure member 118 fixed to the body portion 116 for closing the open end of the body portion 116. The body portion 116 has an inner circumferential surface 120 which is divided into two portions, i.e., a large-diameter portion 122 on the side of its open end and a small-diameter portion 124 remote from the open end, which two portions cooperate with each other to define a shoulder 126 therebetween. At an axial portion of the outer circumferential surface of the body portion 116 near its open end, there is formed a circumferential groove 128 in which a lubricant oil flows so as to assure, a smooth reciprocating movement of the piston 14 within the cylinder bore 12.

The closure member 118 is a generally disc-shaped member which consists of a circular plate portion 130, and an annular fitting protrusion 132 which protrudes from one of the opposite end faces (the inner end face) of the plate portion 130 and which has a diameter smaller than that of the plate portion 130. The circular plate portion 130 may be referred to as a large-diameter portion while the annular fitting protrusion 132 may be referred to as a small-diameter portion. A shoulder 134 is formed between the circular plate portion 130 and the annular fitting protrusion 132. The closure member 118 has a circular recess 138 which defines the annular fitting protrusion 132 and is open in an end face 136 of the fitting protrusion 132, so that the weight of the closure member 118 is reduced. The closure member 118 is fitted into the inner circumferential surface 120 of the body portion 116 such that the shoulder 134 of the closure member 118 is held in abutting contact with an end face 140 of the body portion 116, and such that end face 136 of the annular fitting protrusion 132 of the closure member 118 is held in abutting contact with the shoulder 126 formed between the large-diameter portion 122 and the small-diameter portion 124 of the inner circumferential surface 120 of the body portion 116. In this state, the outer circumferential surface of the fitting protrusion 132 of the closure member 118 engages the large-diameter portion 122 of the inner circumferential surface 120 of the body portion 118. The closure member 118 is fixed to the body portion 116 by welding. The compression reaction force which acts on the end face of the piston 14, which end face partially defines the pressurizing chamber 79, as a result of compression of the refrigerant gas in the pressurizing chamber 79 during the compression stroke of the piston 14, is received by the abutting contact of the shoulder 134 of the closure member 118 with the end face 140 of the body member 116 and the abutting contact of the end face 136 of the fitting protrusion 132 of the closure member 118 with the shoulder 126 of the body portion 116, as well as contacting circumferential surfaces of the body portion 116 and the closure member 118, which surfaces are bonded by welding. In FIG. 2, the cylindrical wall thickness of the body portion 116 is exaggerated for easier understanding.

Figure 3:
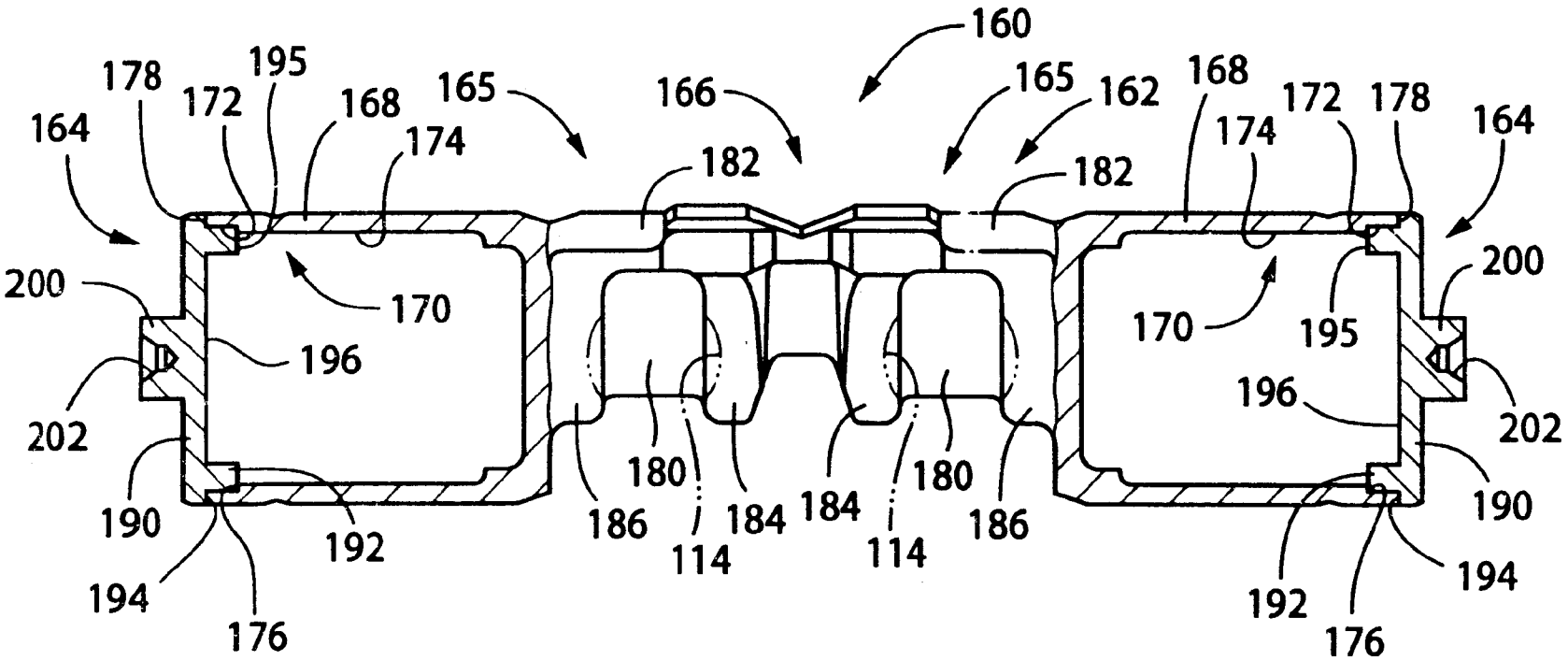
FIG. 3 is a front elevational view partly in cross section showing a body member used for manufacturing the piston of FIG. 2, after closing members are fixed to the body member.

Two pieces of the piston 14 constructed as described above are produced from a single blank 160 shown in FIG. 3. The blank 160 used for producing the two pistons 14 consists of a body member 162 to which two closing members 164 are fixed to the respective opposite open ends of the body member 162. The body member 162 consists of a twin engaging section 166 and two cylindrical hollow head sections 168 formed integrally with the twin engaging section 166 such that the two hollow head sections 168 extend from the opposite ends of the twin engaging section 166 in the opposite directions. The twin engaging section 166 consists of two engaging sections 165 which are formed in series and integrally with each other and which provide respective two engaging portions 70 of the two single-headed pistons 14. Each of the two hollow head sections 168 is closed at one of its opposite ends which is on the side of the twin engaging section 166, and is open at the other end. The two head sections 168 are concentric with each other. It may be considered that the body member 162 consists of two body members each of which includes a single engaging section 165 and a single head section 168 and which are connected to each other at their ends on the side of the engaging sections 165 such that the two head sections 168 are concentric with each other, and such that each head section 168 is open at one of its opposite ends remote from the engaging section 165.

Each head section 168 of the body member 162 has an inner circumferential surface 170 which is divided into two portions, i.e., a large-diameter portion 172 on the side of its open end and a small-diameter portion 174 remote from the open end, which two portions cooperate with each other to define a shoulder 176 therebetween. This shoulder 176 provides the shoulder 126 of the piston 14. The end face 178 of the head section 168 provides the end face 140 of the body portion 116 of the piston 14.

The head section 168 has a cylindrical wall thickness of 1.5 mm except its axial end portion corresponding to the large-diameter portion 172. Each of the two engaging sections 165 includes the base section 182 functioning as the base portion 108 of the piston 14 and a pair of opposed parallel arm sections 184, 186 functioning as the arm sections 110, 112 of the piston 14. Reference numeral 180 denotes two bridge portions, each of which connects the inner surfaces of the arm sections 184, 186, in order to reinforce the engaging section 165 for thereby increasing the rigidity of the body member 162. Each bridge portion 180 functions as a reinforcing portion by which the body member 162 is protected from being deformed due to heat.

Figure 4:
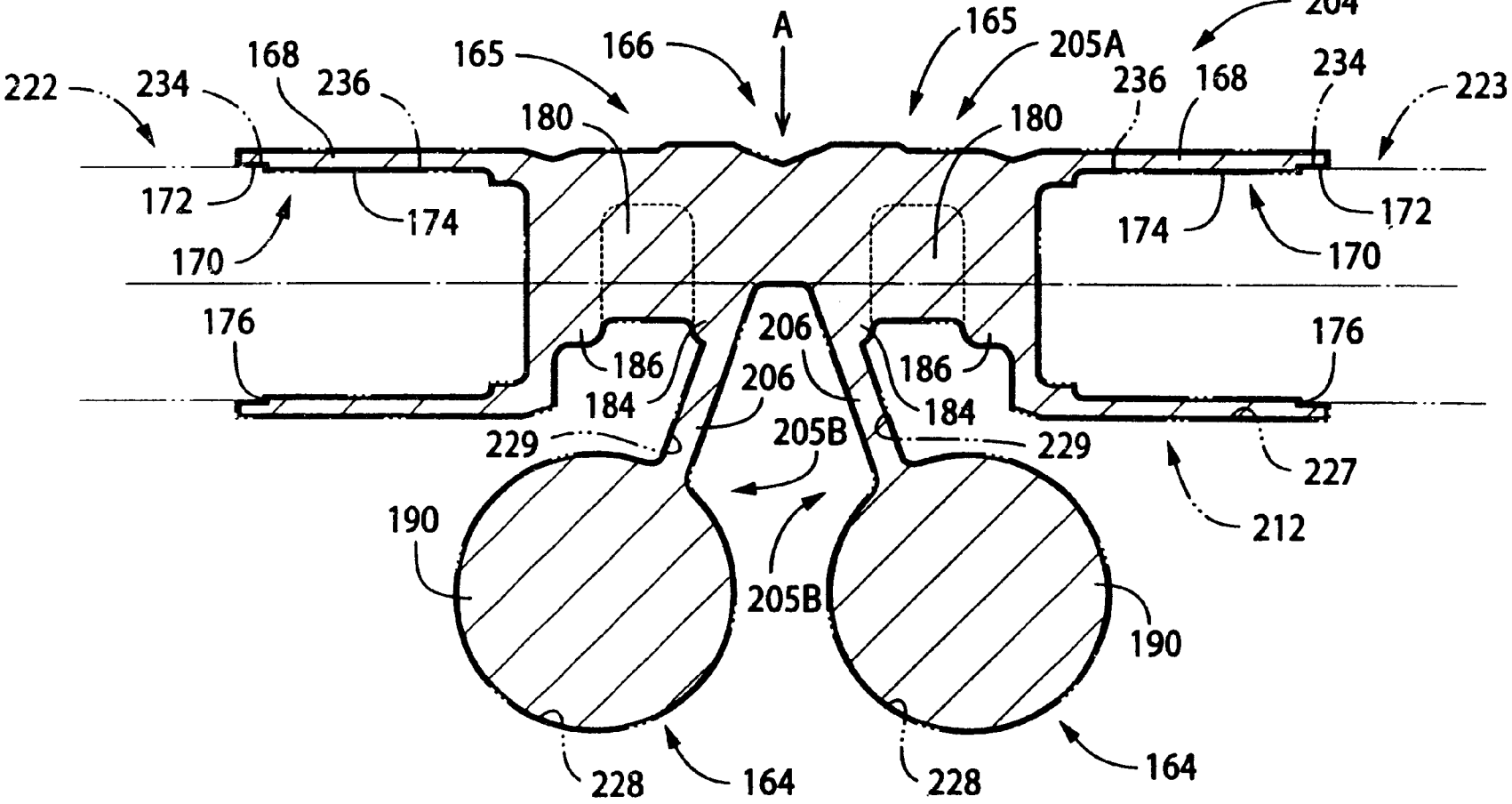
FIG. 4 is a front elevational view in cross section showing a blank for the piston formed by a pore-free die-casting method according to the invention.

The two closing members 164 are identical in construction with each other as shown in FIG. 4. Like the closure member 118, each of the closing members 164 includes a circular plate portion 190 and an annular fitting protrusion 192 which protrudes from one of the opposite end faces (the inner end face) of the circular plate portion 190. A shoulder 194 is formed between the circular plate portion 190 and the annular fitting protrusion 192. The closing member 164 has a circular recess 196 which defines the annular fitting protrusion 192 and is open in an end face 195 of the fitting protrusion 192. The shoulder 194 and the recess 196 of the closing member 164 respectively provide the shoulder 134 and the recess 138 of the closure member 116. The circular plate portion 190 of each closing member 164 has a holding portion 200 formed at a central portion of its outer end face which is opposite to the inner end face on which the annular fitting protrusion 192 is formed. The holding portion 200 has a circular shape in cross section, and has a center hole 202. The circular plate portion 190 and the fitting protrusion 192 of the closing member 164 have the same dimensional relationship as the circular plate portion 130 and the fitting protrusion 132 of the closure member 116, and a detailed explanation of which is dispensed with.

In the present embodiment, an integral precursor 204 as shown in FIG. 4 is initially produced by pore-free die-casting, as described in greater detail by reference to FIGS. 4–6, for obtaining the blank 160 for the body member 162 of the piston 14, and the two closing members 164 of the piston 14. The integral precursor 204 is formed of a metallic material in the form of an aluminum alloy. The pore-free die-casing of the integral precursor 204 is an initial part of a step of forming the blank 160 for the piston 14. As shown in FIG. 4, the integral precursor 204 consists of a first portion 205A which gives the body member 162 of the blank 160, and a pair of second portions 205B which give the respective two closing members 164. For easier understanding, the cylindrical wall thickness of each head section 168 of the body member 162 is exaggerated in FIG. 4. In the integral precursor 204, the two second portions 205B is formed integrally with the first portion 205A. Each of the two second portions 205B consists of the closing member 164 and a connecting part 206 which connects the second portion 205B to a part of the first portion 205A, which part gives the arm section 184 of the corresponding engaging section 165 of the body member 162. The connecting part 206 extends between the distal end of the arm section 184 and the outer circumferential surface of the circular plate portion 190 of the closing member 164. Thus, the first portion 205A and the pair of second portions 205B are formed integrally with each other.

There will be described a process of manufacturing the blank 160 and the two closing members 164 for the single-headed piston by the pore-free die-casting method while using a die-casting device 210 schematically shown in FIG. 5.

The die-casting device 210 used in the present invention includes a pair of mold halves 218, 220 which are carried by a main body (not shown) of the device, and a pair of slide cores 222, 223 which are disposed in the two mold halves 218, 220 such that the slide cores 222, 223 indicated in the two-dot chain line in FIG. 4 are slidably movable relative to the mold halves 218, 220. The two mold halves 218, 220 have respective molding surfaces 224, 226 which cooperate with the outer circumferential surfaces of the slide cores 222, 223, to define therebetween a mold cavity 212. Into the mold cavity 212, a molten aluminum alloy is introduced for forming the blank 160. The mold half 218 is stationary while the mold half 220 is movable relative to the stationary mold half 218. Contact surfaces 214, 216 of the two mold halves 218, 220 define a parting plane 219, at which the two mold halves 218, 220 are butted together and are spaced apart from each other by a suitable moving device (not shown), such that the movable mold half 220 is moved toward and away from the stationary mold half 218.

Figure 6:
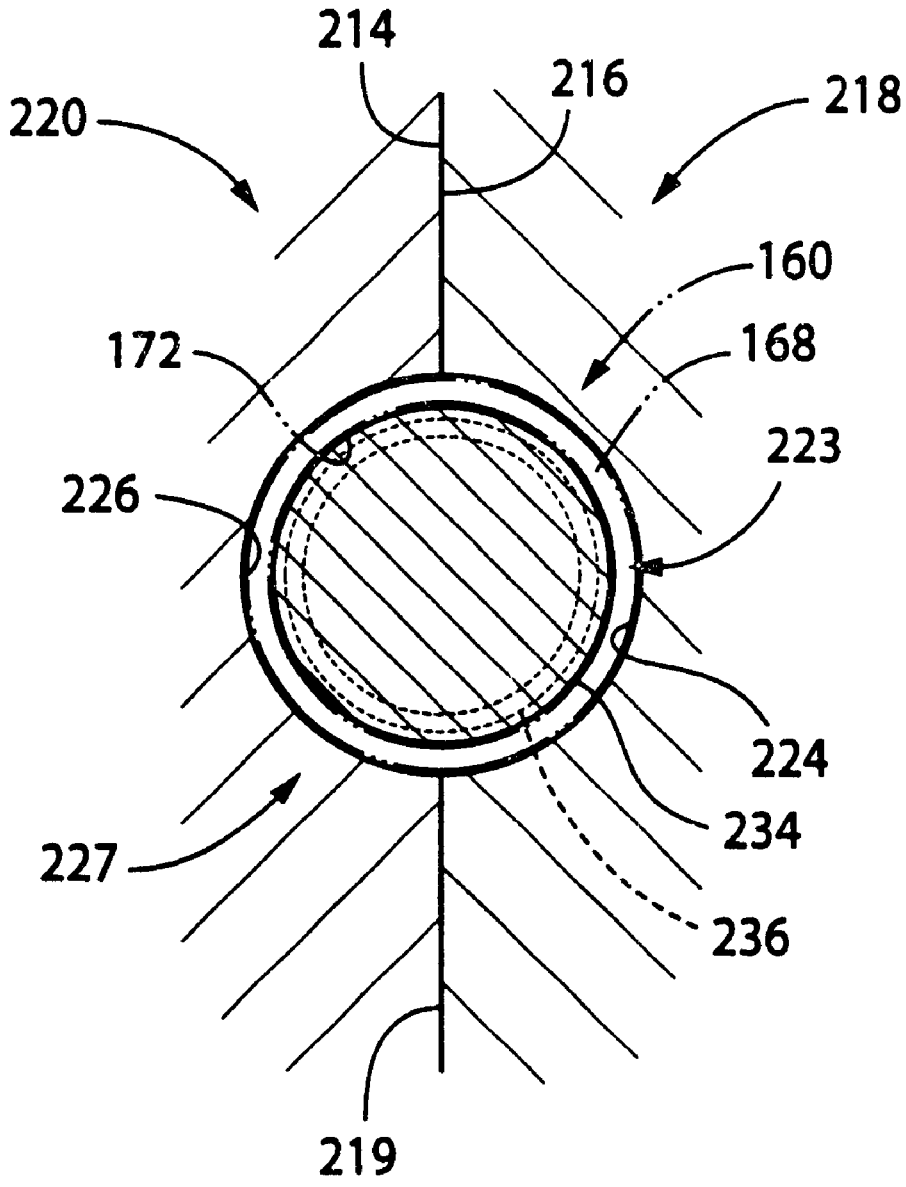
FIG. 6 is a side elevational view in cross section of a casting mold used in die-casting the blank.

As indicated in FIG. 6, the parting plane 219 includes the centerline of the blank 160 passing the centers of the generally cylindrical head sections 168 and is parallel to the direction of extension of the arm sections 184, 186 from the base sections 182 of the engaging sections 165. As shown in two-dot chain lines in FIG. 4, the mold cavity 212 includes a first cavity portion 227 for forming the first portion 205A which provides the body member 162, and two second cavity portions 228 for forming the pair of second portions 205B which provide the respective two closing members 164. The first cavity portion 227 and each of the second cavity portions 228 are held in communication with each other through a connecting passage 229 which corresponds to the above-indicated connecting part 206 which extends between the first cavity portion 227 and the corresponding second cavity portion 228.

The slide cores 222, 223 are disposed in the casting mold 210 consisting of the two mold halves 218, 220, such that the slide cores 222, 223 are advanced into and retracted out of the casting mold 210 by a suitable drive device not shown. The drive device for driving the slide cores 222, 223 include hydraulically operated cylinders, for example. The slide cores 222, 223 indicated in the two-dot chain line in FIG. 4 are slidably movable in a direction parallel to the centerline of the body member 162 and in a direction perpendicular to the parting direction described above. Each slide core 222, 223 is movable between an advanced position in which the outer circumferential surface of each slide core 222, 223 cooperates with the molding surfaces 224, 226 of the two mold halves 218, 220 to define the molding cavity 227, and a retracted position in which a front end portion of each slide core 222, 223 is located outside the casting mold. The front end portion of each slide core 222, 223 has a configuration which gives the inner circumferential surface of the head section 168. The outer circumferential surface of each slide core 222, 223 is divided into two sections, i.e., a large-diameter section 234 whose diameter corresponds to that of the large-diameter portion 172 of the head section 168 and a small-diameter section 236 whose diameter corresponds to that of the small-diameter portion 174 of the head section 168. For easier understanding, the cylindrical wall thickness of the head section 168 is exaggerated in FIG. 6.

Figures 5A, 5B, 5C:
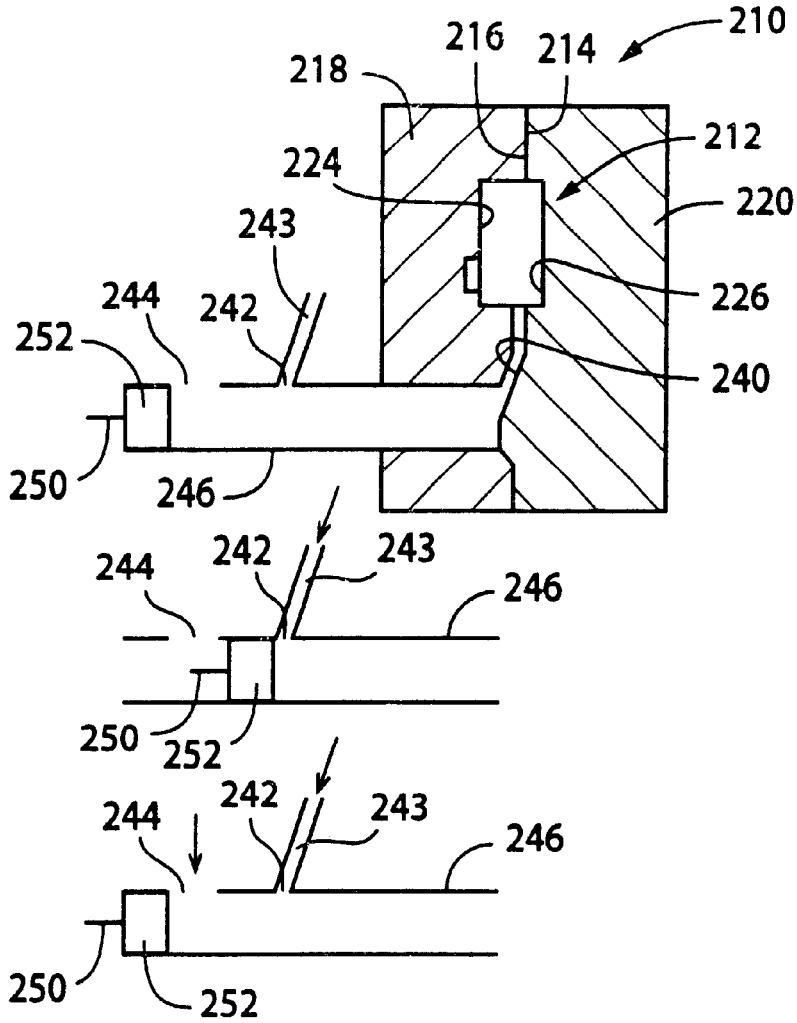
FIGS. 5A–5C are views for explaining a process of die-casting the blank according to the pore-free die-casting method.

As shown in FIG. 5, the lower end of the mold cavity 212 is held in communication with a sleeve 246 via a runner 240. The sleeve 246 is provided with an $O_2$ inlet 242 and a molten metal inlet 244. The runner 240 has a gate (not shown) provided at one of its opposite open ends on the side of the mold cavity 212. This gate has a diameter smaller than the other portion of the runner 240. The runner 240 is held in communication with the sleeve 246 at the other open end. The $O_2$ inlet 242 is provided in the sleeve 246 such that it is located nearer to the casting mold 210 than the molten metal inlet 244. The $O_2$ inlet 242 is selectively connected and disconnected to and from an $O_2$ supply device or an $O_2$ supply source (not shown) via an $O_2$ supply passage 243. A molten metal (a molten aluminum alloy in the present embodiment) is injected through the molten metal inlet 244 into the sleeve 246. The sleeve 246 is a cylindrical member which extends through the stationary mold half 218 so that one of its opposite end portions remote from the mold cavity 212 is located outside the casting mold 210. The $O_2$ inlet 242 and the molten metal inlet 244 are provided on the side of the above-indicated one end portion of the sleeve 246 located outside the casting mold. A plunger chip 252 formed at one end of a plunger 250 and having a diameter larger than that of the plunger 250 is slidably fitted in the sleeve 246. The plunger 250 is fixed to a piston of a plunger drive device in the form of a hydraulically operated cylinder (not shown) such that the plunger 250 is movable together with the piston. The above-indicated $O_2$ supply device, the plunger drive device, the casting mold moving device, and the die-casting device including the slide core drive device are controlled by a control device not shown. When the plunger chip 252 is in a retracted position shown in FIG. 5A, the molten metal inlet 244 is open for permitting the molten metal to flow therethrough into the sleeve 246.

When the plunger chip 252 is in the retracted position of FIG. 5A, the two mold halves 218, 220 are butted together at the parting plane 219 so that the two mold halves 218, 220 are inhibited from moving relative to each other. In this state, each slide core 222, 223 is advanced into the two mold halves 218, 220. Subsequently, the plunger chip 252 is advanced past the molten metal inlet 244 and is stopped at an advanced position before it reaches the $O_2$ inlet 242, as shown in FIG. 5B, so that the mold cavity 212 formed in the casting mold is inhibited from communicating with the atmosphere. In this state, an oxygen as a reactive gas is supplied through the $O_2$ inlet 242, so as to fill the mold cavity 212. Namely, the atmosphere in the mold cavity 212 is substituted with the oxygen. Thereafter, the plunger chip 252 is placed in its retracted position with the oxygen being supplied through the $O_2$ inlet 242 into the sleeve 246, as shown in FIG. 5C. In this state, the molten metal is introduced into the sleeve 246 through the molten metal inlet 244. Subsequently, the plunger chip 252 is advanced at a high speed toward the casting mold 210, so that the level of the molten metal in the sleeve 246 is raised, whereby the molten metal is introduced into the runner 240, and then jetted into the mold cavity 212 through the narrow gate provided at the end of the runner 240. The oxygen in the mold cavity 214 reacts with the aluminum, and the mold cavity 214 is placed in a vacuum state in the absence of the oxygen, for thereby preventing the air, especially, nitrogen, from being trapped in the molten metal.

In the present embodiment, the molten metal flows through the runner 240 into the mold cavity 212 in a direction indicated by an arrow A in FIG. 4. According to this arrangement, each second cavity portion 228 for providing each second portion 205B of the integral precursor 204 which gives the closing member 164 is located relatively close to the inlet of the casting mold through which the molten metal is jetted into the mold cavity 212. Further, each second cavity portion 228 is held in communication with a part of the the first cavity portion 227, which part corresponds to the engaging section 165 having a considerably larger wall thickness than the hollow head section 168. Accordingly, the molten metal can easily flow from the first cavity portion 227 into the second cavity portion 228, for forming the second portion 205B which gives each closing member 164, facilitating the formation of each second portion 205B of the precursor 204. The molten metal can also effectively flow through the first cavity portion 227 which is defined by and between the molding surfaces 224, 226 and the outer circumferential surfaces of the slide cores 222, 223 and which has a relatively small radial dimension corresponding to the small cylindrical wall thickness of the head section 168. The outer circumferential surface of the each slide core 222, 223 gives the inner circumferential surface 170 of the head section 168.

Since the molten metal is jetted through the narrow gate into the mold cavity 212 in the form of a fine mist, the molten metal is rapidly cooled after reaction with the oxygen, so as that the solidified blank 160 has a chilled layer having a relatively large thickness. A chilled layer formed by the conventional die-casting method generally has a thickness of about 20 $\mu$m whereas the chilled layer formed by the present pore-free die-casting method has a thickness in the range of 40~50 $\mu$m. The chilled layer is characterized by a discontinuous change in the crystallization ratio of the primary crystal or $\alpha$-phase (proeutectic) and the eutectic silicon with respect to each other. Since the chilled layer has high values of hardness and strength, the presence of the chilled layer as the superficial portion of the blank 160 is effective to increase the strength of the head section 168 while reducing its wall thickness.

The movable mold half 220 is separated from the stationary mold half 218 a predetermined time after the molten metal was injected into the mold cavity 212, and the slide cores 222, 223 are retracted out of the formed head sections 168 of the blank 160. Then, the formed integral precursor 204 for the blank 160 is removed from the stationary mold half 218. Subsequently, the two second portions 205B for the two closing members 164 are cut from the first portion 205A for the body member 162, by cutting off the connecting parts 206. Thus, the body member 162 and the two closing members 164 are obtained.

As shown in FIG. 3, each closing member 164 is fitted into the open end of the hollow head section 168 to form the head portion 72 of the piston 14, such that the annular fitting protrusion 192 of the closing member 164 engages the large-diameter portion 172 of the head section 168. The closing member 164 is inserted into the hollow head section 168 such that the shoulder 194 of the closing member 164 is held in abutting contact with the annular end face 178 of the head section 168, and such that the shoulder 176 of the head section 168 is held in abutting contact with the annular end face 195 of the fitting protrusion 192 of the closing member 164. In this state, the body member 162 and the closing members 164 are welded together by an electron beam welding. In the present embodiment, since the body member 162 (blank 160) and the closing members 164 are both formed by the pore-free die-casting method and the formed head sections 168 have a relatively small cylindrical wall thickness, the head sections 168 have a reduced weight without prior mechanical working operations such as machining and grinding operations on their inner circumferential surfaces 170, resulting in a reduced cost of manufacture of the blank 160 for the single-headed pistons 14. In the present embodiment, the closing members 164 may be fitted in the body member 162 without effecting a mechanical working operation on the inner circumferential surface 170 of each head section 168. As needed, the inner circumferential surface 170 of each head section 168 may be subjected to a mechanical working operation at its axial end portion near the open end, to which the closing member 164 is fixed. Alternatively, the other portion of the inner circumferential surface 170 in addition to the above-described axial portion may be subjected to a mechanical working operation. In either case, the area of the inner circumferential surface 170 subjected to the working operation is small, reducing the cost of manufacture of the piston.

After the two closing members 164 are fixedly fitted in the respective open end portions of the body member 162 as described above, a machining operation is performed on the outer circumferential surfaces of the hollow head sections 168 which give the head portions 72 of the two pistons 14, respectively, and the exposed outer circumferential surfaces of the closing members 164. This machining operation is effected on a lathe or turning machine such that the blank 160 is held by chucks at the holding portions 200 of the closing members 164, with the blank 160 being centered with two centers engaging the center holes 202, and such that the assembly of the body member 162 and the two closing members 164 fitted in the body member 162 is rotated by a suitable rotary drive device through the chucks.

Then, the outer circumferential surfaces of the hollow head sections 168 of the body member 162 and the closing members 164 are coated with a suitable material, such as a film of polytetrafluoroethylene. A machining operation is performed to cut off the holding portions 200 from the outer end faces of the closing members 164, and a centerless grinding operation is performed on the coated outer circumferential surfaces of the hollow head sections 168 and the closing members 164, so that the two portions which provide the head portions 72 of the two pistons 14 are formed. In the next step, a cutting operation is performed near the two bridge portions 180 of the twin engaging section 166, to form the recesses 114 in which the shoes 76 of the pistons 14 are received. Thus, the two portions which provide the engaging portions 70 of the two pistons 14 are formed at the twin engaging section 166. Finally, the twin engaging section 166 is subjected at its axially central portion to a cutting operation to cut the blank 160 into two pieces which provide the respective two single-headed pistons 14.

According to the present embodiment, the piston has a high degree of strength while having a reduced weight by reducing the cylindrical wall thickness of the head sections 168. Each closing member 164 is fitted in the open end of the head section 168 remote from the engaging section 165. The piston 14 receives a side force from the swash plate 60 during its reciprocating movement, in a direction perpendicular to the centerline of the piston 14, and the head portion 72 of the piston 14 fitted in the cylinder bore 12 tends to be inclined with respect to its centerline. In this case, the head portion 72 contacts the inner surface of the cylinder block 10 defining the cylinder bore 12, with a relatively large force, at one end of the head section on the side of the engaging portion 70. Further, a bending moment acting on the piston 14 is particularly large at the above-indicated one end of the head portion 72 on the side of the engaging portion 70. In the blank 160 produced according to the present invention, one end of the head section 168, which contacts the inner surface of the cylinder block 10 defining the cylinder bore 12, with a relatively large contacting force, and which receives a relatively large bending moment, is formed integrally with the engaging section 165, while the other end of the head section 168, which is subjected to a relatively small contacting force and a small bending moment, fixedly engages the closing member 164. According to this arrangement, the piston has an improved durability.

The parting plane which is defined by the two mold halves 218, 220 of the casting mold used for die-casting the blank for the two single-headed pistons may be otherwise established. For instance, the parting plane may be parallel to a plane which includes a centerline of the blank 160 passing the centers of the head sections 168 and which is perpendicular to the direction of extension of the arm sections 184, 186 from the base sections 182. In this case, the parting plane passes a part of the engaging sections 165 which has the largest dimension as measured in the direction perpendicular to the direction of extension the arm sections 184, 186.

In the illustrated embodiment wherein the integral precursor 204 consisting of the first portion 205A and the two second portions 205B is initially formed, the two second portions 205B for the two closing members 164 are formed concurrently and together with the first portion 205A for the blank 160 for body member 162. Then, the integral precursor 204 is cut to provide the body member 162 and the two closing members 164, and the two closing members 164 are fixed to the body member 162. Subsequently, two pieces of the single-headed piston 14 are produced from the single blank 160, by cutting the body member 162, at a position intermediate the two arm sections 184. Since the integral precursor 204 for the body member 162 and the two closing members 164 is formed in one die-casting step, the cost of manufacture of the piston 14 by die-casting can be significantly reduced. However, the body member 162 and the two closing members 164 may be separately formed by pore-free die-casting. Alternatively, a single piston may be produced by fixing a closing member to a single body member which consists of a head section and an engaging section. In this case, a precursor for the closing member may be die-cast integrally with a precursor for the body member, or the closing member may be formed separately from the body member. Alternatively, only the closing members may be formed by forging. If the closing members have a simple configuration, the closing members may be produced by effecting a machining operation on an ordinary cylindrical member which is commercially available.

In the illustrated embodiment, the inner circumferential surface of the head section 168 is divided into the large-diameter portion 172 and the small-diameter portion 174, which two portions cooperate with each other to define the shoulder 176 therebetween. However, the inner circumferential surface of the head section 168 may have a constant diameter over the entire axial length of the head section 168, without such a shoulder. In this case, the closing member 164 is fixed to the head section 168 such that the shoulder 194 of the closing member 164 is held in abutted contact with an annular end face of the head section 168.

The configuration of the closing member is not particularly limited. For instance, each closing member is a circular plate which engages inner circumferential surface 170 of the head section 168 such that one of its opposite end faces is held in abutting contact with the shoulder 176 of the head section 168.

The closing members may be welded to the body member of the blank for the piston by means of a laser beam. Alternatively, the closing members and the body member may be bonded together by any suitable means other than the beam welding. For instance, the closing members are fixed to the body member by bonding using an adhesive agent or an alloy having a lower melting point than those members, such as a soldering or brazing material. Further, the closing members may be fixed to the body member by caulking or by means of screws. Alternatively, the closing members may be fixed to the body member by utilizing frictional contact or plastic material flow between the two members. Further, the closing members may be press-fitted into the body member. The above-described methods may be employed in combination.

In the illustrated embodiment, the body member and the closing members are formed of an aluminum alloy. However, these members may be formed of other metallic material such as a magnesium alloy.

The construction of the swash plate type compressor for which the piston 14 is incorporated is not limited to that of FIG. 1. For instance, the solenoid-operated control valve 90 is not essential, and the compressor may use a shut-off valve which is mechanically opened and closed depending upon a difference between the pressures in the crank chamber 86 and the discharge chamber 24. In place of or in addition to the solenoid-operated control valve 90, a solenoid-operated control valve similar to the control valve 90 may be provided in the bleeding passage 100. Alternatively, a shut-off valve may be provided, which is mechanically opened or closed depending upon a difference between the pressures in the crank chamber 86 and the suction chamber 22.

While the presently preferred embodiment of this invention has been described above, for illustrative purpose only, it is to be understood that the present invention may be embodied with various changes and improvements such as those described in the SUMMARY OF THE INVENTION, which may occur to those skilled in the art.

What is claimed is:

1. A method of producing a piston for a swash plate type compressor including a head portion which is slidably fitted in a cylinder bore of the compressor, and an engaging portion which engages a swash plate of the compressor, said method comprising the steps of:

forming a blank by a pore-free die-casting method, said blank including a hollow cylindrical head section which corresponds to said head portion and which has a closed end and an open end, and an engaging section which corresponds to said engaging portion and which is formed integrally with said hollow cylindrical head section at said closed end; and fixing a closing member to said hollow cylindrical head section of said blank so as to close said open end, for thereby providing said head portion of the piston.

2. A method according to claim 1, further comprising a step of: preparing a casting mold consisting of two mold halves which define a parting plane that includes a centerline of said hollow cylindrical head section, at least in a portion of said mold halves which gives said hollow cylindrical head section, said casting mold being provided with a slide core which is movable in a direction parallel to said centerline of said cylindrical head section and which gives an inner circumferential surface of said cylindrical head section.

3. A method according to claim 1, wherein said hollow cylindrical head section has a cylindrical wall thickness of not larger than 1.8 mm.

4. A method according to claim 1, wherein said step of forming said blank comprises forming two body members each having said engaging section and said hollow head section, said two body members being integrally connected to each other at their ends on the side of said engaging sections, such that said hollow cylindrical head sections of said two body members are concentric with each other, and such that each of said hollow cylindrical head sections of said two body members is open at one of its opposite ends which is remote from said engaging sections.

5. A method according to claim 1, wherein at least a portion of said inner circumferential surface of said head section is not subjected to a machining operation.

6. A method according to claim 1, wherein said step of forming a blank comprises forming by pore-free die-casing an integral precursor including a first portion which gives said blank, and a second portion which gives said closing member, by using a casting mold having a mold cavity which includes a first cavity portion for forming said first portion of said integral precursor and a second cavity portion for forming said second portion of said integral precursor, said first and second cavity portions being held in communication with each other.

7. A method according to claim 6, wherein said second cavity portion is held in communication with a part of said first cavity portion, which part corresponds to said engaging section of said blank.

8. A method according to claim 1, wherein at least an axial portion of said inner circumferential surface of said hollow cylindrical head section, which axial portion does not include an axial end portion thereof near said open end of said hollow cylindrical head section to which said closing member is fixed, is not subjected to a machining operation.

9. A method of producing a piston for a swash plate type compressor including a hollow head portion which is slidably fitted in a cylinder bore of the compressor, and an engaging portion which engages a swash plate of the compressor, said method comprising the steps of:

forming a partial piston by introducing a molten metal into a casting mold which is filed with a reactive gas, wherein the partial piston takes the form of the piston but with an open ended head portion; and completing the piston by fixing a closing member on the open ended head portion of the partial piston.

10. The method according to claim 9, wherein:

the closing member is fixed to the partial piston by welding.

11. The method of claim 9, wherein:

the hollow head portion of the piston is formed in the partial piston by providing the casting mold a cylindrical slide core which is movable in a direction parallel to the centerline of the open ended head portion of the partial piston.

12. The method according to claim 9, wherein:

at least a portion of the open ended head portion of the partial piston is not subjected to a machining operation.

* * * * *